US007246540B2

(12) United States Patent
Rillera

(10) Patent No.: US 7,246,540 B2
(45) Date of Patent: Jul. 24, 2007

(54) NUT AND BOLT HOLDER AND STARTER

(76) Inventor: Robert P. Rillera, 2509 George Mason Dr., Virginia Beach, VA (US) 23456

( * ) Notice: Subject to any disclaimer, the term of this patent is extended or adjusted under 35 U.S.C. 154(b) by 21 days.

(21) Appl. No.: 11/025,552

(22) Filed: Dec. 30, 2004

(65) Prior Publication Data

US 2006/0144194 A1 Jul. 6, 2006

(51) Int. Cl.
*B25B 9/00* (2006.01)
*B25B 23/10* (2006.01)

(52) U.S. Cl. ..... 81/13; 81/55; 81/443; 81/112; 294/100

(58) Field of Classification Search ..... 81/13, 81/487, 55, 443, 111–114, 116, 90.2, 90.3, 81/90.9, 92; 294/100; 279/43–43.6, 46.1–46.6, 279/107, 50, 37
See application file for complete search history.

(56) References Cited

U.S. PATENT DOCUMENTS

| | | | | | |
|---|---|---|---|---|---|
| 66,585 | A | * | 7/1867 | Harvey | 81/443 |
| 228,860 | A | * | 6/1880 | Birch | 81/112 |
| 900,766 | A | * | 10/1908 | Nagel | 81/112 |
| 957,760 | A | * | 5/1910 | Fray | 279/40 |
| 965,054 | A | * | 7/1910 | Weeks | 294/100 |
| 1,171,315 | A | * | 2/1916 | Bryant | 294/86.27 |
| 1,232,735 | A | * | 7/1917 | Torvik | 81/112 |
| 1,280,533 | A | * | 10/1918 | Pegler | 81/112 |
| 1,690,018 | A | * | 10/1928 | Kerfoot | 81/114 |
| 2,053,980 | A | * | 9/1936 | Turner | 294/100 |
| 2,122,340 | A | * | 6/1938 | Durno | 294/100 |
| 2,212,013 | A | * | 8/1940 | Devareaux | 294/100 |
| 2,285,995 | A | * | 6/1942 | McDermott | 57/76 |
| 2,320,967 | A | * | 6/1943 | Dunkelberger | 294/100 |
| 2,429,444 | A | * | 10/1947 | Yett | 294/100 |
| 2,532,972 | A | * | 12/1950 | Vertin | 81/443 |
| 2,579,438 | A | * | 12/1951 | Longfellow | 81/453 |
| 2,585,098 | A | * | 2/1952 | Elliott | 294/100 |
| 2,594,321 | A | * | 4/1952 | Leftwich | 81/443 |
| 2,669,896 | A | * | 2/1954 | Clough | 81/128 |
| 2,753,746 | A | * | 7/1956 | Cummings | 81/112 |
| 2,762,408 | A | * | 9/1956 | Baldwin | 81/453 |

(Continued)

*Primary Examiner*—D. S. Meislin
(74) *Attorney, Agent, or Firm*—Maxine Barasch & Assoc.; David L. Banner

(57) ABSTRACT

Three congruent prongs (16A, 16B, 16C) mounted on a shaft tube (12), converges simultaneously when an operating sleeve (14) moves forward. This action, along with their notches and shape provides a firm grip for holding and starting nuts and bolts. These prongs, made out of 304 grade stailess steel bands, provide good spring-like flexibility and rigidity. The concave sides of the prongs mate with the outside surface of the shaft tube (12) every time the operating sleeve (14) is moved forward. These physical features provide consistent alignment of the prongs every time the tool is used. With rubber sealant (16D) coated on the inside surface of the prongs, the nut and bolt starter gives a firm grip to hold and start a wide variety of shapes and sizes of screws, nuts and bolts. Additional uses of this tool are done with the prop rod (20) supplementing the prongs. More versatility of this instrument is derived from the prop rod (20) using nuts of the same thread pattern to position flat washers and lock washers into their threaded studs. Furthermore, the socket extension receiver (30) provides a convenient extra-reach supplement whenever needed.

16 Claims, 6 Drawing Sheets

U.S. PATENT DOCUMENTS 2,947,564 A * 8/1960 Winther ..... 294/100
3,056,318 A * 10/1962 Anderson et al. ..... 81/112
3,394,623 A * 7/1968 Kinakin ..... 81/55
3,604,487 A * 9/1971 Gilbert ..... 81/443
4,125,938 A * 11/1978 Clark ..... 29/764
4,862,773 A * 9/1989 Batten ..... 81/55
4,987,634 A * 1/1991 Weihrauch ..... 15/209.1
5,213,015 A * 5/1993 Disston, Jr. ..... 81/90.9
5,323,674 A * 6/1994 Fidkowski ..... 81/487
6,000,300 A * 12/1999 Plamondon ..... 81/90.2
6,073,520 A * 6/2000 Bueno et al. ..... 81/53.2
6,571,505 B1 * 6/2003 Poiencot, Jr. ..... 43/5

* cited by examiner

NUT AND BOLT HOLDER AND STARTER

CROSS-REFERENCE TO RELATED APPLICATIONS

Not Applicable

BACKGROUND

1. Field of Invention

This invention relates to hand tools, specially for holding and starting nuts and bolts.

2. Discussion of Prior Art

Nuts that are screwed to threaded studs and bolts that are screwed to threaded holes are difficult to start with the fingers in hard to reach spaces. The current available tools for this problem are the magnetic inserts that go to their corresponding sockets with extensions or nut drivers. These inserts, when used with the sockets or nut drivers, will hold and start a nut or bolt in any direction. However, this combination does not work with non-magnetic nuts and bolts.

SUMMARY

My nut and bolt holder and starter works on a variety of sizes of hardware. It also works well with non-magnetic hardware.

OBJECTS AND ADVANTAGES

Accordingly, besides the objects and advantages of being able to hold and start nonmagnetic nuts and bolts, several objects and advantages of my hand tool are:

a) to provide holding and starting to a wide range of sizes of nuts and bolts with just one tool:
b) to hold and start screws and bolts of the socket-head type:
c) to hold and start countersink slotted screws:
d) to hold and start countersink Phillips® crossed-slot head screws:
e) to hold and start roundhead slotted screws:
f) to hold and start roundhead Phillips® crossed-slot head screws:
g) to hold and start pan head slotted screws:
h) to hold and start pan head Phillips® crossed-slot head screws:
i) to hold and start oval head screws:
j) to hold and start carriage bolts and screws:
k) to hold and start cylindrical barrel nuts:
l) to hold and start hexagonal barrel nuts:
m) to hold, insert or remove automobile dashboard instrument bulbs:
n) to hold and place flat washers into studs:
o) to hold and place lock washers into studs:
p) to hold and start hexagonal nuts of the self-locking nylon insert type: and
q) to hold and start square nuts.

REFERENCE NUMERALS IN DRAWINGS

| | |
|---|---|
| 12 | main shaft tube |
| 12A | main shaft tube slot |
| 14 | operating sleeve |
| 14A | operating sleeve finger actuator |
| 16A | notched prong 1 |
| 16B | notched prong 2 |
| 16C | notched prong 3 |
| 16D | silicone rubber sealant |
| 18 | fastening bushing |
| 20 | prop rod |
| 20A | T-nut, optional |
| 22 | prop rod gib |
| 24 | prop rod adjuster, locking screw |
| 26A | gland nut, stopper |
| 26B | gland nut |
| 26C | gland nut |
| 28 | handle |
| 28A | handle slot |
| 30 | socket extension receiver |
| 30C | locking holes |
| 32 | socket extension, optional |
| 32A | locking ball |
| 34 | snaking flexible socket driver, optional |

Description—FIGS. 1, 3, 4, 5, 6, 7 and 8—Preferred Embodiment

Figure 1:
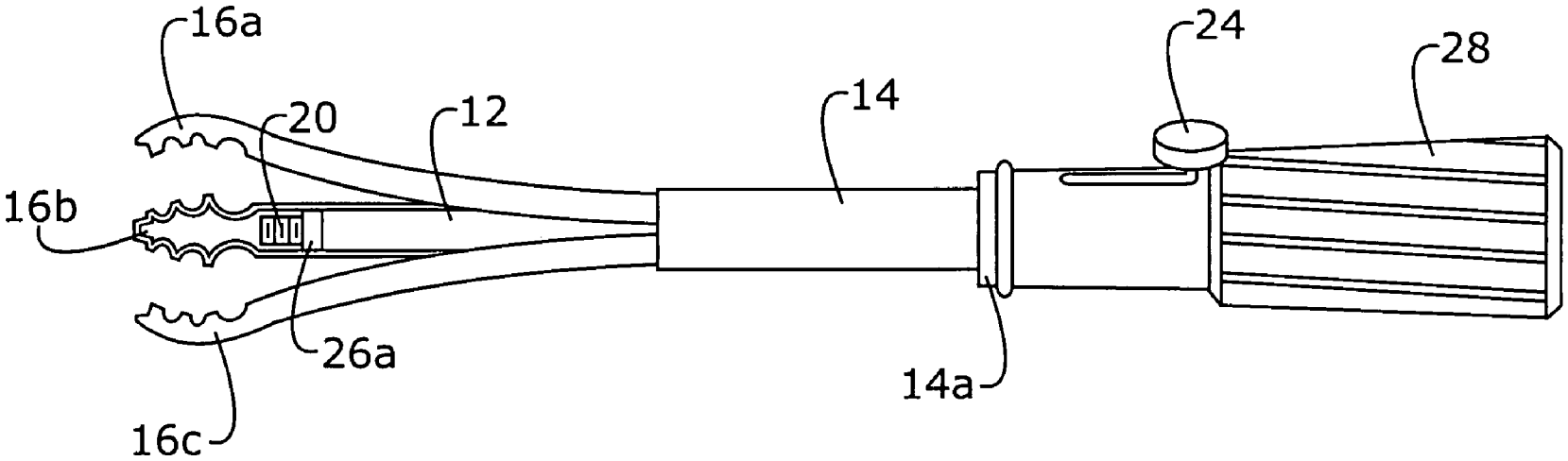
FIG. 1 is a side view that shows most of the parts.

FIG. 1 shows the general view of my nut and bolt starter. At the left end of FIG. 1 are three prongs that are congruent. The three prongs 16A, 16B and 16C make up the preferred embodiment of my hand tool. These prongs are made of 304 grade stainless steel banding material. The prongs are shaped to fit the outside of a main shaft tube, part 12. The prongs spread away at the tips.

Figure 5:
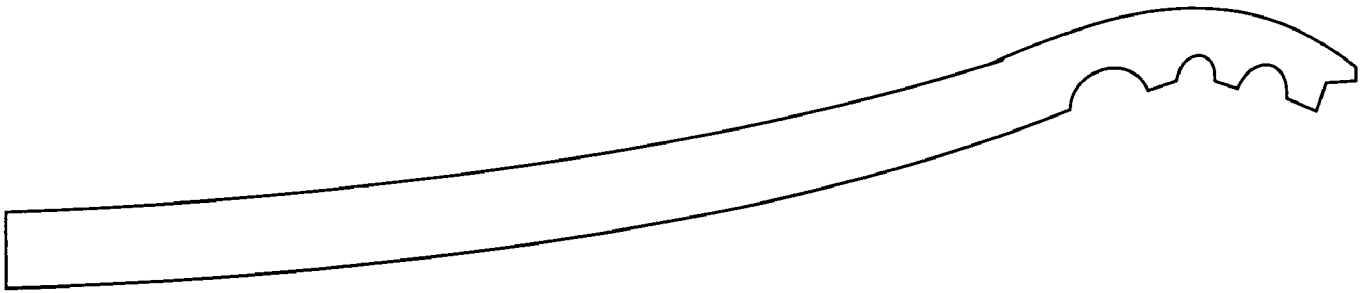
FIG. 5 is a full side view of one of the prongs.
Figure 6:
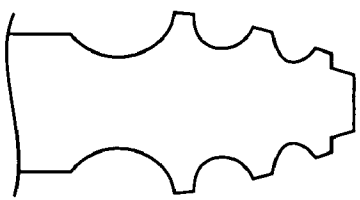
FIG. 6 is an enlarged view of a prong tip seen from the convex side.
Figure 7:
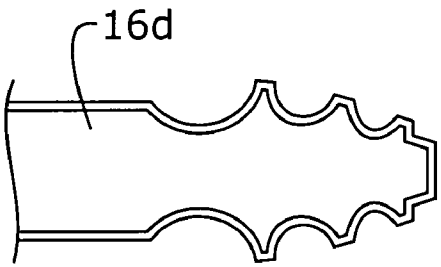
FIG. 7 is an enlarged view of a prong tip seen from the concave side.

However, the prongs are best illustrated individually on FIG. 5, FIG. 6 and FIG. 7. The tips of the prongs are arrow-shaped. Each side of the tips of the prongs are three notches. The forward most part of the arrowheads are pairs of the smaller notches opposite each other. The middle part of the arrowhead are pairs of the bigger notches. The same larger notches are on the rear of the arrowhead. The necks of the prongs are made with deep crimps. The concave side of the prong tips are coated with silicone rubber, 16D, FIG. 7.

Figure 4:
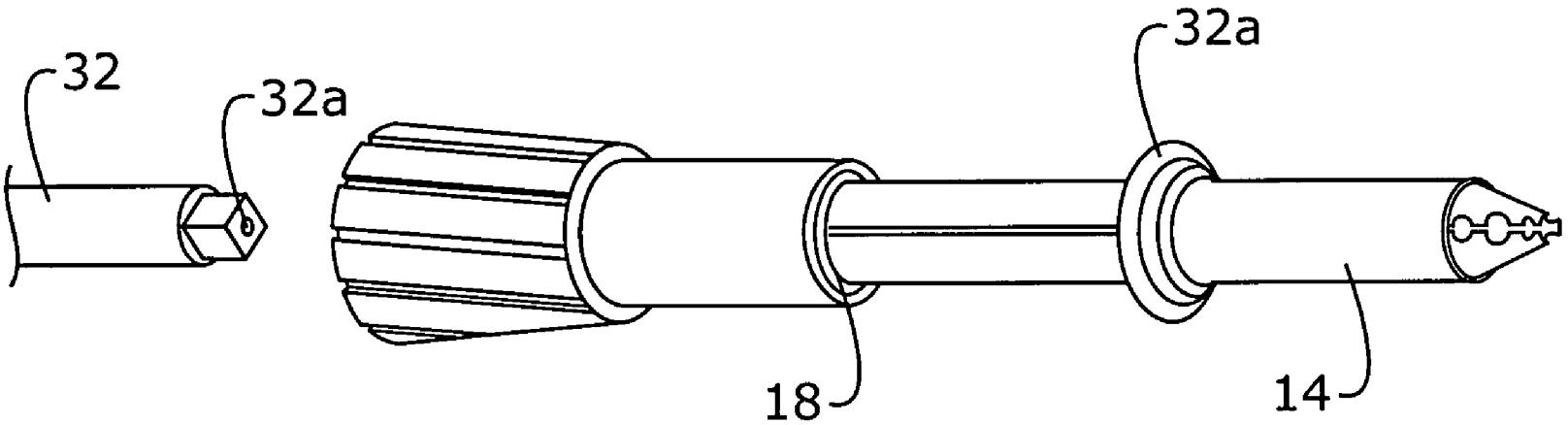
FIG. 4 is an isometric view from the front, rotated at 45 degrees, tool in clamped position.
Figure 8:
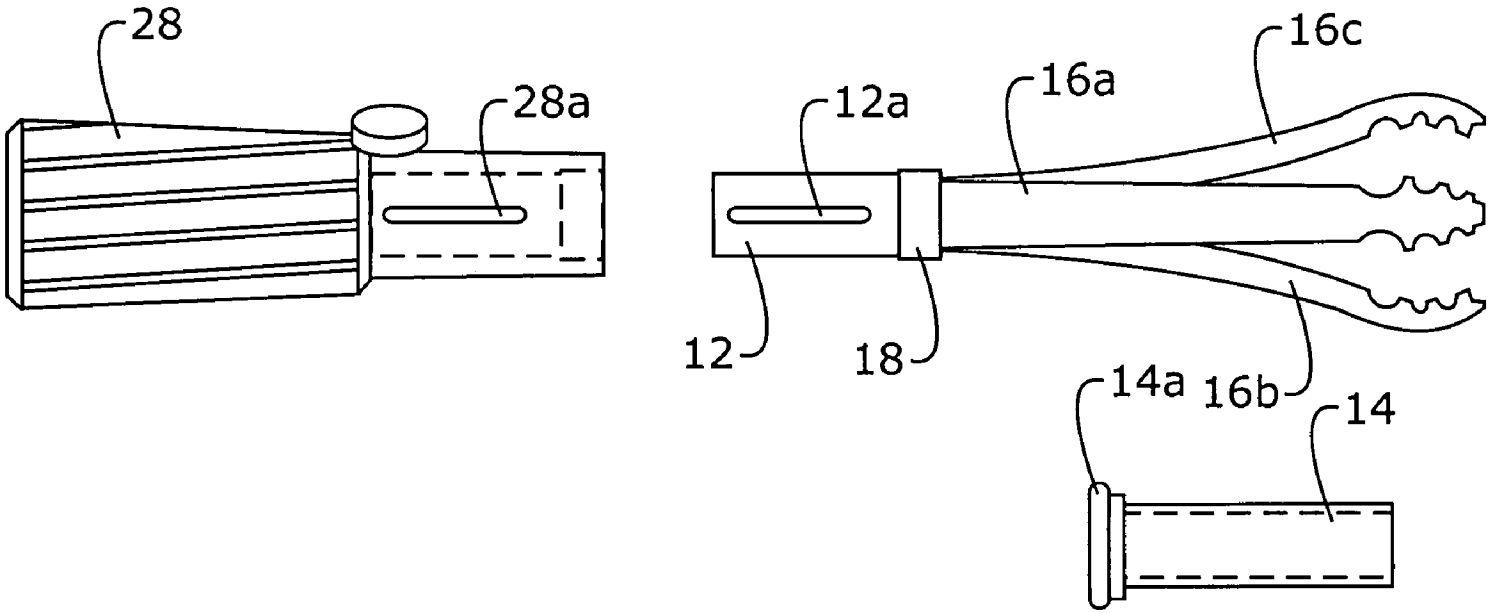
FIG. 8 is a view with the major parts exploded.

The prongs are secured near the back end of 12 by a stainless steel bushing, part 18. These prongs have a hair-line-gap between them. Part 18 is shown in FIG. 1, FIG. 4 and FIG. 8. The main shaft tube, part 12, was made from a stainless steel tube. At the back end of 12, a slot was cut, part 12A.

As part of the preferred embodiment, is an operating sleeve, part 14 that contains the three prongs. The length of

Figure 3:
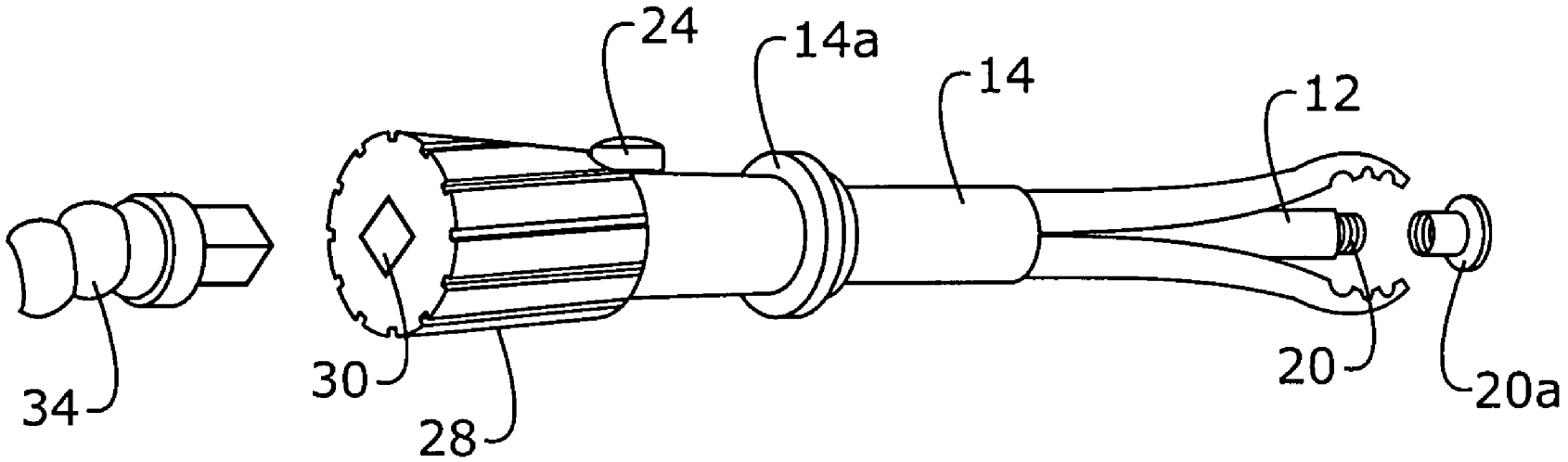
FIG. 3 is an isometric view from the rear, rotated at 45 degrees.

14 is less than one-half the length of the prongs. Part 14 was made of thin wall tube. At the base of 14, is a finger actuator. An operating sleeve finger actuator, part 14A, was made from hard plastic. Part 14A was made to tightly fit on 14. Part 14A is best illustrated in FIG. 3, FIG. 4 and FIG. 8.

Figure 2:
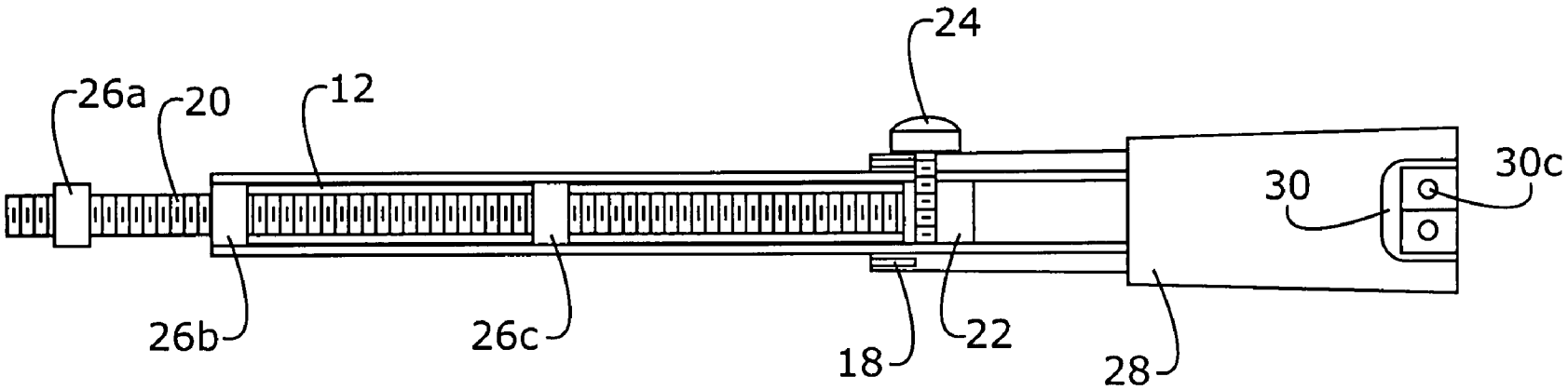
FIG. 2 is a cross-sectional view that shows the internal parts.

FIGS. 1, 2 and 4—Additional Embodiments

Contained in the flute of shaft 12 is a support or prop rod 20. The prop rod is a threaded rod shorter than the main shaft tube 12. The prop rod 20 is in the center of the flute of shaft 12. This is accomplished with a support base and three support nuts, hereinafter referred to as "gland nuts".

The prop rod gib, part 22 sits at the back end of the cavity of shaft 12. Gib 22 is made of nylon. It is cylindrical in shape. The diameter of gib 22 is slightly less than the inside diameter of shaft 12. The gib was drilled and tapped in the forward face and close to the rear of the cylinder, diametrically. The forward tapped hole of gib 22 accepts the prop rod. The rear diametrical tapped hole houses a screw. These parts are best illustrated in FIG. 2.

The prop rod is supported and centered inside the cavity by gland nuts 26A, 26B and 26C. These gland nuts are made of nylon. The gland nuts are circular in shape, with the outside diameter slightly less than the inside diameter of shaft 12. Nuts 26A, 26B and 26C are screwed into rod 20. Nut 26A is placed near the front end of rod 20. When the prop rod is in full retracted position, half of 26A is inside the forward cavity of the main shaft tube. Forward of 26A, are several threads of rod 20. Gland nut 26B is placed close to 26A. When the prop rod is extended fully forward, nut 26B is in the front end of shaft 12 flute and still in the shaft. Nut 26C is screwed to rod 20 halfway between 26B and gib 22.

A locking screw, part 24 is placed in the rear threaded hole of gib 22. The prop rod adjuster, locking screw is a knob screw made of stainless steel. The circumferential side of the head of 24 has grooves and the top is knurled. The length of the screw shaft is long enough for the tip to reach the bottom of shaft 12 cavity and the head does not touch the outside surface of a handle, part 28. At the forward end of the prop, is an optional T-nut, part 20A screwed into 20.

FIGS. 1, 2, 3 and 8—Alternative Embodiment

Connected to the rear of shaft 12, is a handle. The handle, part 28 is made of hard plastic. About two-fifths of the handle is the forward portion. The forward portion of 28 is diametrically lesser than the rear portion and has a slot cut lengthwise, 28A. The forward of the handle is machined to hold the back portion of shaft 12 together with bushing 18. This is shown clearly in FIG. 2 and FIG. 8.

The rear portion of 28 has grooves equally spaced in the rear portion. A half-circle was cut in the rear portion near the back part of 28A. At the breech of 28, a receptacle was made to accept a socket extension, part 30. The socket extension receiver was tightly fitted flush with the rear of the handle. Receiver 30 was made from smaller steel socket. Slots were cut along its length. Four locking holes, one on each side, were made in a staggered fashion, FIG. 2. A socket extension, part 32, is inserted into 30. A locking ball, part 32A, is pressed into one of the holes, part 30C, of 30, FIG. 2 and FIG. 4. A snaking flexible socket driver, part 34, is inserted into part 30, FIG. 3.

Operation of Invention

The three notched prongs of my nut and bolt starter make the preferred embodiment of this hand tool. The user of this tool simply inserts a nut or bolt head in the middle of the prongs. Then pushing 14A forward until the user gets the desired position and clamping tension on the nut or bolt, the user is ready to start.

In the case of larger nuts and bolts, my tool works best by holding the corners of the hardware with the clamping prongs. It is also best to use the third row of notches, where the face and sides of the hardware will be clamped firmly.

When holding smaller sizes of nuts and bolts, it is best to use the front notches to grip the sides of the nuts and screw heads. The middle set of notches is best to use on intermediate sizes of nuts and bolts. It is up to the user of this hand tool which notches the user is comfortable with when starting intermediate sizes hardware.

The prongs close in together simultaneously with equal forces and stability, as sleeve 14 is moving forward. This is accomplished because the three prongs are congruent and the prongs always get centered to the shaft. The shaft also functions as a rail to the concave inner sides of the of the prongs, as sleeve 14 moves forward and presses the prongs into the shaft.

Another major function of shaft 12 is housing the prop rod, the gib and the three support nuts. Furthermore, shaft 12 also connects the preferred embodiment to the handle. Rod 20 is used when the prongs cannot provide a firm and steady hold on some shapes of hardware that are circular or very small. If after the small or circular-shaped hardware is clamped by the prongs and a steadier hold is desired, the user simply slides the prop rod until it is against the hardware by moving screw 24 forward and rotate the head half a turn clockwise. This locks the prop rod in place.

Besides giving support for firm and steady hold to the prongs, rod 20 has other functions. In tight spaces, placing flat washers and lock washers in the studs is difficult. The user simply screws a nut into rod 20, illustrated in FIG. 3 with part 20A, clamp the flat washer or lock washer between the prongs, position the hardware where it goes, then push the hardware into the stud with the prop rod. In the case of larger flat washers and lock washers, the user simply slides sleeve 14 out, screw a T-nut 20A onto rod 20, then the user can place the larger hardware in place. Removing sleeve 14 allows the prongs wider openings for larger hardware. This process is simpler by placing the flat washer and lock washer one at a time. To put back 14, the user simply clamps the prongs together with one hand and slip 14 with the other hand.

Part 24, prop rod adjuster, locking screw is defined by its name. The prominent size of its head, plus the grooves and knurls make adjusting and locking rod 20 with an easy movement of the thumb. Screw 24 does not shake loose but easy to turn is the result of using nylon in making gib 22.

Also made of nylon, the three gland nuts that are screwed to rod 20. The gland nuts do not shake loose from their intended position. The nylon threads make these nuts and gib 22 similar to self-locking nuts. Gib 22 keeps rod 20 in place without using jamb nuts or thread seals.

The handle is part 28. The shape is shown in FIGS. 1, 2, 3, 4 and 8. The shape of 28 was formed for ease of operation of 14A. Also, the handle enables the ease of operating screw 24. Nevertheless, the screw remains unobtrusive, whether being used or not. The handle slot, 28A is aligned with slot 12A after the handle and shaft 12 are assembled together.

This contributes to the ease of operating screw 24. The grooves on the rear portion of the handle provide good grip when using the hand tool. Furthermore, the rear portion of the handle provides a part of the alternative embodiment.

The breech of the handle has a socket extension receiver, part 30. The socket extension receiver gives the user a convenient way to extend the reach of the tool when needed, FIG. 3 and FIG. 4. Extra reach can be provided by one or more socket extensions, part 32. A snaking flexible socket driver, part 34 can be used into receiver 30 to supplement the hand tool whenever the user opts for easier control when the condition requires.

The four sides of receiver 30 have their locking holes located at different distances from the face of the receiver. The staggered locking holes of the extension receiver allow the user to eliminate loose lockup of the receiver 30 with any socket extension. Simply, engage the side that locks best with the locking ball, 30B. Thus, the user can get firm lockup from various makes of socket extensions.

DESCRIPTION AND OPERATIONS OF ALTERNATIVE EMBODIMENTS

Preferred Embodiment

The three elongated notched prongs are mounted on a tubular shaft. These prongs have hairline gaps among them. Also the tips of the prongs are arrow-shaped and have three notches on both sides of the tips. Furthermore, the concave side of the tips are coated with silicone rubber sealant. The operating sleeve contains the three prongs.

The movement of the operating sleeve forward clamps the prongs simultaneously together. With the notches and the silicone rubber, the prong tips clamping action make a firm hold on a nut or bolt head.

Additional Embodiment

The prop rod is housed inside the main shaft tube. With three gland nuts and the prop rod gib, the prop rod is centered inside the cavity of the shaft tube. An optional T-nut is screwed at the forward tip of the prop rod. The prop rod adjuster, locking screw is screwed to the prop rod gib in the middle.

The prop rod gives support to the prongs when bigger sizes of nuts and bolts are started. Furthermore, the T-nut is screwed to the tip of the prop rod for starting larger sizes of nuts. This is accomplished by pushing the prop rod until the T-nut had braced the nut being clamped and tightening the prop rod locking screw.

Alternative Embodiment

The forward portion of the handle is smaller in diameter than rear portion. The forward portion contains the head of the prop rod adjuster, locking screw. Also, the breech of the handle holds the socket extension receiver.

The forward portion of the handle makes the prop rod adjuster, locking screw unobtrusive when using this hand tool. The socket extension receiver gives extra reach to this hand tool simply by inserting a socket extension into the receiver. Furthermore, more versatility is available by inserting a snaking flexible socket driver into the receiver.

Conclusion, Ramifications, and Scope

The preferred embodiment of my nut and bolt starter is it can hold and start a wide range of sizes of the common hexagonal nuts and hexagonal head bolts. This embodiment is for both magnetic and non-magnetic nuts and bolts. It is done by the simultaneous movements of the three notched prongs and the operating sleeve. The fastening bushing can be eliminated by tack-welding the notched prongs to the main shaft tube and grind the welds smooth. This will also simplify joining the prongs and shaft tube to the handle.

Other different hardware my hand tool can hold and start are:

- the clamping action of the notched prongs, together with the firm gripping these prongs provide and further supplemented with rubber sealant in the prongs easily hold socket head bolts.
- the same operation of the parts mentioned above will hold and start countersink slotted screws
- furthermore, the same parts and operation as stated above will hold and start countersink Phillips® crossed-slot head screws
- the same combination, as above will hold and start roundhead Phillips® crossed-slot head screws
- the same also applies for starting roundhead slotted screws
- the make and operation of the prongs will start pan head Phillips® crossed-slot head screws
- the same parts and operation will start pan head slotted screws
- the prongs' movement and make will hold and start carriage bolts and carriage screws
- the action of these prongs will hold and start cylindrical barrel nuts
- same as above will start hexagonal barrel nuts
- the make and operation of these prongs will remove and install automobile dashboard instrument light bulbs
- the three prongs and the prop rod will place lock washers into studs
- the same prongs and prop rod will put flat washers into studs
- the make and operation of the prongs will hold and start hexagonal nuts with nylon self-locking inserts
- the make and operation of these prongs will hold and start square nuts
- the make of the socket receiver in the breech adds versatility and options to my nut and bolt starter.

Although the descriptions above contain many specificities, these could not be construed as the limit of uses of my tool. There are other possible uses.

Furthermore, the parts could be made with different materials and different shapes.

Accordingly, the scope of my nut and bolt starter should be determined not by the embodiments illustrated, but by the appended claims and their legal equivalents.

I claim:

1. A hand-held apparatus for starting nuts and bolts, comprising:

a) a substantially cylindrical handle having a proximal end and a distal end and comprising a concentric, cylindrical, hollow region disposed therein open at said distal end and adapted to receive and secure a main shaft tube therein;

b) an elongated, hollow, cylindrical main shaft tube having a proximal end fixedly retained within said cylindrical hollow region, and a distal end;

c) a prop rod having external threads disposed thereupon disposed within said hollow main shaft tube and slidably movable therein along a major axis thereof between a first, retracted position and a second, extended position;

d) means threadably affixed upon said external threads of said prop rod for centering and supporting said prop rod within said main shaft tube;

e) at least two resilient prongs disposed around and along said main shaft tube, each of said at least two resilient prongs having a proximal end affixed to said main shaft tube proximate said distal end of said main shaft tube, each of said at least two resilient prongs having a notched distal end biased outwardly away from said distal end of said main shaft tube; and f) an operating sleeve circumferentially disposed around said at least two resilient prongs and slidable along said major axis of said main shaft tube to selectively adjust said outward bias of said notched proximal ends of said at least two resilient prongs.

2. The hand-held apparatus for starting nuts and bolts as recited in claim 1, wherein said substantially cylindrical handle comprises grooves formed in the outer surface thereof.

3. The hand-held apparatus for starting nuts and bolts as recited in claim 1, said handle further comprising a socket extension receiver disposed in said proximal end thereof.

4. The hand-held apparatus for starting nuts and bolts as recited in claim 1, wherein said elongated, hollow, cylindrical main shaft tube comprises a slot disposed proximate said proximal end thereof.

5. The hand-held apparatus for starting nuts and bolts as recited in claim 1, wherein said means for supporting comprises a gland nut having internal threads adapted to receive said external threads of said prop rod, and an outside diameter sized to allow sliding of said gland nut within said hollow main shaft tube.

6. The hand-held apparatus for starting nuts and bolts as recited in claim 1, wherein said means for supporting comprises a prop rod gib having internal threads adapted to receive said external threads of said prop rod, and an outside diameter sized to allow sliding of said gib within said hollow main shaft tube, said prop rod gib further comprising means for locking said prop rod gib at a predetermined position therealong.

7. The hand-held apparatus for starting nuts and bolts as recited in claim 5, wherein at said glad nut comprises nylon.

8. The hand-held apparatus for starting nuts and bolts as recited in claim 1, wherein said at least two resilient prongs comprise three prongs disposed around and along said main shaft tube.

9. The hand-held apparatus for starting nuts and bolts as recited in claim 1, wherein said notched proximal ends of said at least two resilient prongs comprise an arrowhead shape and wherein said notched proximal end comprises at least three notches, each having a notch depth.

10. The hand-held apparatus for starting nuts and bolts as recited in claim 9, wherein said notch depth of a first of said at least three notches is different from said notch depth of a second of said at least three notches.

11. The hand-held apparatus for starting nuts and bolts as recited in claim 1, wherein said notched proximal ends of said at least two resilient prongs comprise a resilient coating on at least an inward facing surface thereof.

12. The hand-held apparatus for starting nuts and bolts as recited in claim 11, wherein said resilient coating comprises a material selected from the group: a rubber sealant, and silicon rubber.

13. The hand-held apparatus for starting nuts and bolts as recited in claim 1, further comprising:

g) a fastening bushing disposed proximate said proximal end of said main shaft tube adapted to secure said proximal ends of said at least two prongs to said main shaft tube.

14. The hand-held apparatus for starting nuts and bolts as recited in claim 1, wherein said operating sleeve comprises a operating sleeve finger actuator disposed proximate a proximal end thereof.

15. The hand-held apparatus for starting nuts and bolts as recited in claim 1, wherein said at least two prongs comprise stainless steel banding material.

16. The hand-held apparatus for starting nuts and bolts as recited in claim 6, wherein said prop rod gib comprises nylon.

* * * * *